US007347578B1

(12) United States Patent
Nourse

(10) Patent No.: US 7,347,578 B1
(45) Date of Patent: Mar. 25, 2008

(54) APPAREL HAVING SELECTIVELY ACTIVATED LIGHT SOURCE

(76) Inventor: Connie L. Nourse, 680 61st St. South, St. Petersburg, FL (US) 33707

( * ) Notice: Subject to any disclaimer, the term of this patent is extended or adjusted under 35 U.S.C. 154(b) by 19 days.

(21) Appl. No.: 11/300,618

(22) Filed: Dec. 14, 2005

(51) Int. Cl.
*F21V 21/08* (2006.01)

(52) U.S. Cl. ..... 362/103; 362/109; 2/159; 2/160

(58) Field of Classification Search ..... 340/432; 362/103, 109; 2/16–20, 159, 161.6, 160.6
See application file for complete search history.

(56) References Cited

U.S. PATENT DOCUMENTS

| | | | | |
|---|---|---|---|---|
| 1,046,225 | A | 12/1912 | Schindler | |
| 1,165,970 | A | 12/1915 | Harris | |
| 1,230,943 | A | 6/1917 | Sundh | |
| 1,496,484 | A | 6/1924 | Monaco | |
| 3,638,011 | A | 1/1972 | Bain et al. | |
| 4,660,033 | A * | 4/1987 | Brandt | 340/825.72 |
| 5,177,467 | A * | 1/1993 | Chung-Piao | 340/574 |
| 5,580,154 | A | 12/1996 | Coulter et al. | |
| 6,049,327 | A | 4/2000 | Walker et al. | |
| 6,529,121 | B2 | 3/2003 | Bush | |
| 6,592,235 | B1 | 7/2003 | Mayo | |
| 6,709,142 | B2 | 3/2004 | Gyori | |
| 6,725,729 | B1 | 4/2004 | Cimmino | |
| 2001/0048596 | A1 | 12/2001 | Kerr | |
| 2002/0075232 | A1 | 6/2002 | Daum et al. | |
| 2004/0128736 | A1 | 7/2004 | Raz et al. | |
| 2004/0255361 | A1 | 12/2004 | Senter et al. | |

* cited by examiner

*Primary Examiner*—Anabel Ton
(74) *Attorney, Agent, or Firm*—George Pappas

(57) ABSTRACT

An apparatus that includes at least one article of apparel mountable on the hand of a user. The apparel is repositionable between a first configuration and a second configuration as the user's hand is repositioned between a first shape and a second shape. An electrical power source, a light source and an electrical circuit operably coupled to both the power source and light source are disposed on the apparel. When the apparel is in the first configuration, the light source is energized and when the apparel is in the second configuration, the light source is de-energized. A control circuit may also be provided to control the energizing and de-energizing of the light source responsive to the repositioning of the apparel between its first and second configurations.

24 Claims, 3 Drawing Sheets

APPAREL HAVING SELECTIVELY ACTIVATED LIGHT SOURCE

BACKGROUND OF THE INVENTION

1. Field of the Invention

The present invention relates to portable lighting devices and, more particularly, to hand held or mounted portable lighting devices.

2. Description of the Related Art

A large variety of portable lighting devices are known in the art and are used for a broad range of different functions. Many such portable lighting devices are designed to provide a signaling function wherein the activation of the lighting device is done to communicate information to another person or merely to enhance the visibility of the individual in possession of the portable lighting device.

The use of a portable, selectively actuable signaling light can be particularly advantageous for bicycle riders. The use of a light when riding a bicycle can greatly enhance the visibility of the rider, particularly in low light conditions, and thereby enhance the safety of the rider. While various portable lighting devices are known, including lighting devices adapted for use on bicycle, an improved lighting device is desirable.

SUMMARY OF THE INVENTION

The present invention provides an apparatus that can be worn on a user's hand and which includes a selectively activated light source. The device is well adapted for use by a cyclist, however, the device may also be used in a wide variety of other applications. The invention comprises, in one form thereof, an apparatus controllable by a hand of a user. The apparatus includes at least one article of apparel mountable on the hand of the user wherein the apparel is repositionable between a first configuration and a second configuration as the user's hand is repositioned between a first shape and a second shape. An electrical power source is provided. A light source is disposed on the apparel and emits light when energized by the electrical power source. Also located on the apparel is an electrical circuit that is operably coupled with the electrical power source and the light source and a flexure responsive circuit element that is coupled with the electrical circuit. The flexure responsive circuit element and apparel define a layered structure wherein movement of the apparel between the first configuration and the second configuration flexes the layered structure with the flexure responsive circuit element having a first shape when the apparel is in the first configuration and a second shape when the apparel is in the second configuration. Movement of the circuit element between the first and second shapes subjects the circuit element to a change in curvature and strain. The circuit element has a first set of operating characteristics within the electrical circuit when it is positioned in its first shape and a second set of operating characteristics when it is in its second shape. The energizing and de-energizing of the light source is responsive to the operating characteristics of the circuit element.

The invention comprises, in another form thereof, an apparatus controllable by a hand of a user. The apparatus includes at least one article of apparel mountable on the hand of the user wherein the apparel is repositionable between a first configuration and a second configuration as the user's hand is repositioned between a first shape and a second shape. An electrical power source is provided. A light source is disposed on the apparel and emits light when it is energized by the electrical power source. An electrical circuit is also disposed on the apparel and is operably coupled with the electrical power source and the light source whereby the light source is selectively energized by the electrical power source through the electrical circuit. Additionally, a control circuit is disposed on the apparel and operably coupled with the electrical circuit and a flexure responsive circuit element disposed on the apparel is operably coupled with the control circuit. The flexure responsive circuit element has a first shape when the apparel is in its first configuration and a second shape when the apparel is in its second configuration. The circuit element has a first set of operating characteristics within the electrical circuit when it is positioned in its first shape and a different, second set of operating characteristics when the circuit element is positioned in its second shape. The control circuit energizes and de-energizes the light source in response to the operating characteristics of the flexure responsive circuit element.

The control circuit may, optionally, be configured to define at least three modes of operation of the light source. These three modes of operation include: (a) an energized mode wherein said light source is continuously energized; (b) a de-energized mode wherein said light source is continuously de-energized; and (c) a flashing mode wherein said light source is repeatedly energized and de-energized. The mode of operation is determined by selectively flexing the flexure responsive circuit element between said first and second shapes of the circuit element.

The invention comprises, in yet another form thereof, a method of operating a light source. The method includes providing at least one article of apparel wherein the apparel is wearable by a user proximate a hand of the user. The apparel is repositionable between a first configuration and a second configuration as the user's hand is repositioned between a first shape and a second shape. The method also includes mounting the light source and a flexure responsive circuit element on the apparel. The flexure responsive circuit element has a first shape when the apparel is in its first configuration and a second shape when the apparel is in its second configuration. The circuit element has a first set of operating characteristics when positioned in the first shape and a different second set of operating characteristics when the circuit element is positioned in its second shape. The method further includes selectively energizing and de-energizing the light source in response to the operating characteristics of the circuit element.

An advantage of the present invention is that it provides a light source that can activated by a user merely by changing the shape of the user's hand, e.g., from a grasping shape to an outstretched shape. This allows a bicyclist to easily energize and de-energize the light source merely by releasing their grip on a handlebar and outstretching their hand to energize the light and subsequently regripping the handlebar to de-energize the light.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
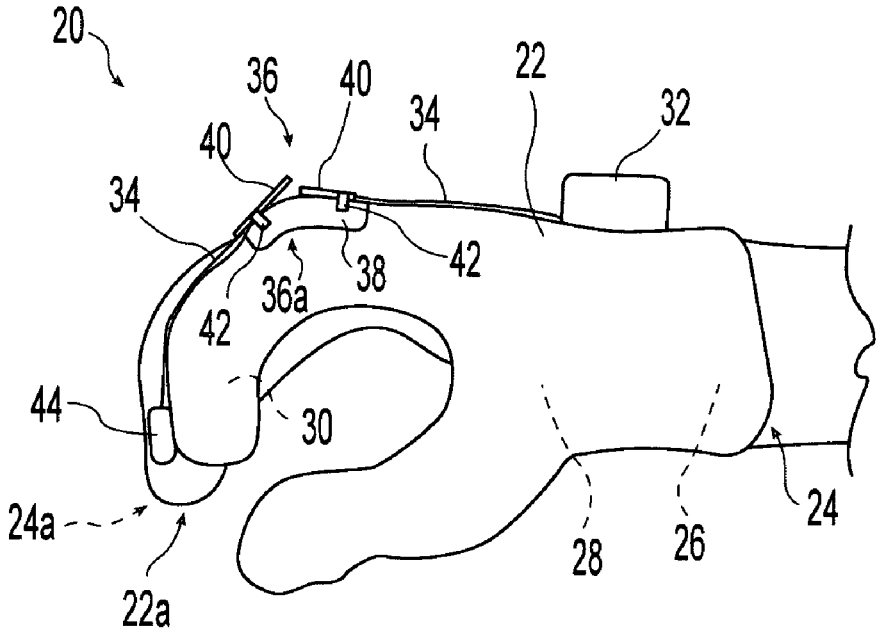
FIG. 1 is a side view of a glove in accordance with the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE INVENTION

Figure 2:
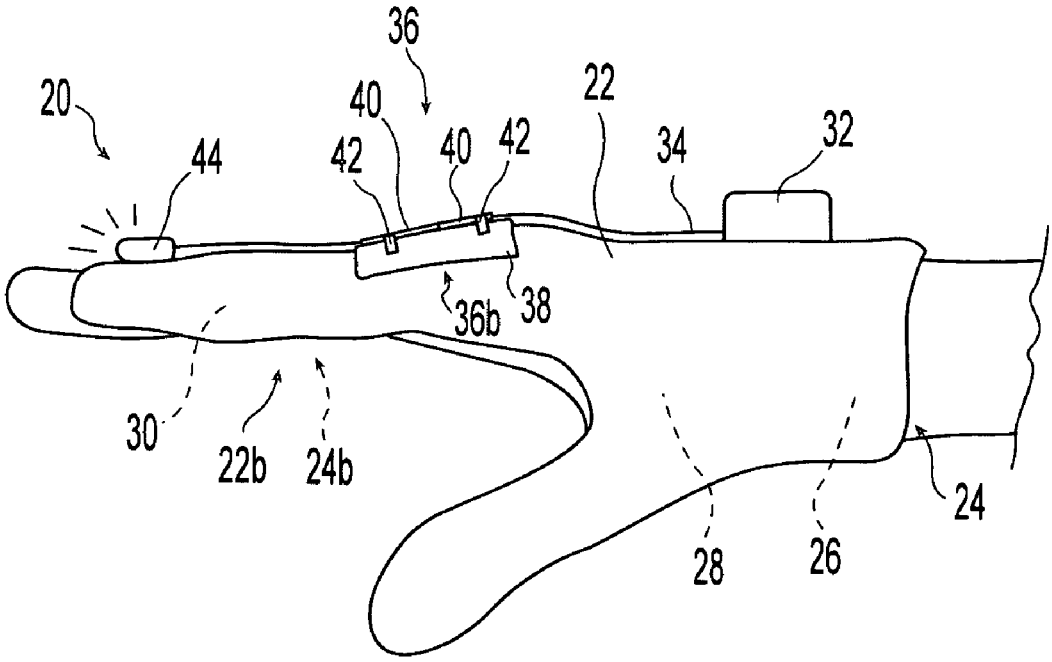
FIG. 2 is a side view of the glove in FIG. 1 in a different configuration.

An apparatus 20 in accordance with the present invention is illustrated in FIGS. 1 and 2. Apparatus 20 includes an article of apparel 22 that is mounted proximate a user's hand 24. In the illustrated example, article of apparel 22 is a glove that closely fits the user's hand 24 covering the hand 22 from a point near wrist 26 to the ends of fingers 30 and including the metacarpal region 28 between wrist 26 and fingers 30.

Figure 3:
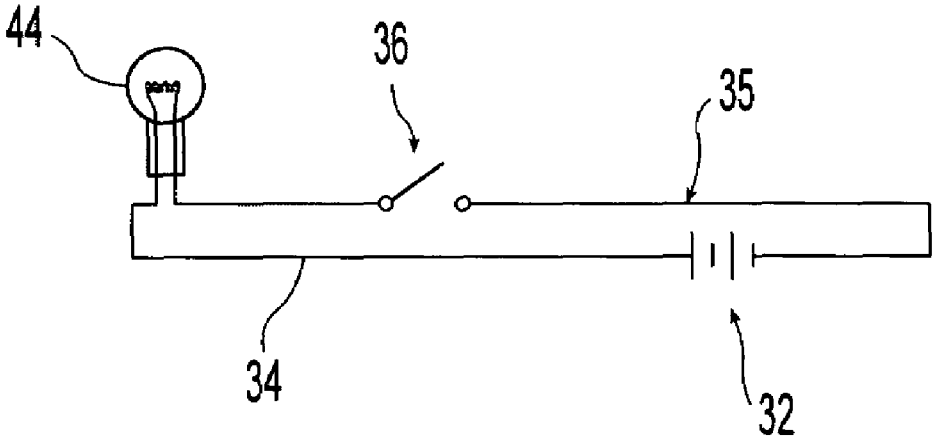
FIG. 3 is a schematic representation of the circuit utilized with the glove of FIG. 1.

Mounted on the backside of glove 22 is an electrical power source 32, wiring 34, electrical switch 36 and a light source 44. In the embodiment of FIGS. 1-3, electrical power source 32 takes the form of a rigid battery pack which receives conventional alkaline batteries and provides means for coupling wiring 34 to the batteries and light source 44 takes the form of an incandescent lamp having a filament. Battery 32, wiring 34 and light 44 can be mounted to glove 22 using adhesives, tape, stitching or other suitable means.

FIG. 3 provides a schematic representation of the device 20 illustrated in FIGS. 1 and 2. As can be understood with reference to FIGS. 1-3, wiring 34 and electrical switch 36 form an electrical circuit 35 that is located on glove 22 and which is operably coupled to both battery 32 and light source 44. This electrical circuit 35 defines a closed conductive path between battery 32 and light source 44 thereby energizing light source 44 when switch 36 is closed as depicted in FIG. 2. When the conductive path defined by electrical circuit 35 between battery 32 and light source 44 is opened by switch 36, as depicted in FIGS. 1 and 3, light source 44 is de-energized.

Switch 36 is a mechanically operated electrical switch which provides a flexure responsive circuit element in electrical circuit 35. In the embodiment of FIGS. 1-3, switch 36 opens and closes as the user's hand 24 is moved between a grasping shape 24*a* (FIG. 1) and a relatively outstretched shape 24*b* (FIG. 2). When the user's hand 24 is in a grasping shape 24*a*, such as when the user is grasping the handlebar of a bicycle, glove 22 is similarly positioned in a grasping configuration 22*a* (FIG. 1). When the user repositions his hand 24 in a relatively outstretched shape 24*b*, such as when the user is signaling a turn while riding a bicycle, glove 22 will be correspondingly repositioned in an outstretched configuration 22*b* (FIG. 2).

Electrical switch 36 is mounted on glove 22 at a position where it will be subject to flexure as the user's hand is moved between outstretched and grasping positions. Placement of switch 36 proximate one of the joints of the user's hand will subject electrical switch 36 to the desired flexure. For example, positioning switch 36 on a portion of glove 22 which envelopes one of the user's fingers 30 will generally subject switch 36 to a sufficient amount of flexure.

In the illustrated example, the entirety of switch 36, including patch 38, is positioned on a portion of glove 22 (i.e., that portion of glove 22 overlaid by patch 38 as seen in FIGS. 1 and 2), which envelopes a single finger 30 of the user. In the illustrated example switch 36 is mounted on that portion of glove 22 which envelopes the index finger of the user. Thus, the user can close and open switch 36 merely by flexing his or her index finger.

In the illustrated embodiment, switch 36 includes a flexible mounting patch 38 such as a relatively thick layer of polymeric material. Rigid electrical contacts 40 are secured to patch 38 at securement locations 42 by adhesives, tape, stitching or other suitable means. After securing contacts 40 to patch 38, patch 38 can be secured to glove 22 and wiring 34 can be conductively coupled to contacts 40. In its relaxed state, patch 38 will assume a generally planar shape and cause contacts 40 to engage providing a conductive path across switch 36. When patch 38 is stretched or bent, as shown in FIG. 1, contacts 40 will disengage thereby opening switch 36 and interrupting the conductive path. Alternative electrical switches may also be employed with the present invention. For example, conductors 40 could be located within an elastomeric tube to both prevent moisture from coming into contact with conductors 40 and provide a mounting structure for conductors 40.

With reference to FIGS. 1 and 2, it can be seen that switch 36 is mounted on glove 22 so that positioning glove 22 in a grasping configuration 22*a* places switch 36 in a shape 36*a* wherein switch 36 is open, and positioning glove 22 in an outstretched configuration 22*b* places switch 36 in a second shape 36*b* wherein switch 36 is closed. As used herein, a flexure responsive circuit element is a circuit element that responds to the flexing or stretching of the circuit element. For example, the illustrated electrical switch 36, which includes flexible mounting patch 38, and opens and closes in response to the flexing of patch 38 and thereby provides a flexure responsive circuit element. This allows the opening and closing of switch 36, and the resultant de-energizing and energizing of light 44, to be controlled by the user merely by changing the shape of the user's hand 24 which is located within glove 22 without requiring the direct manual manipulation of switch 36.

Figure 4:
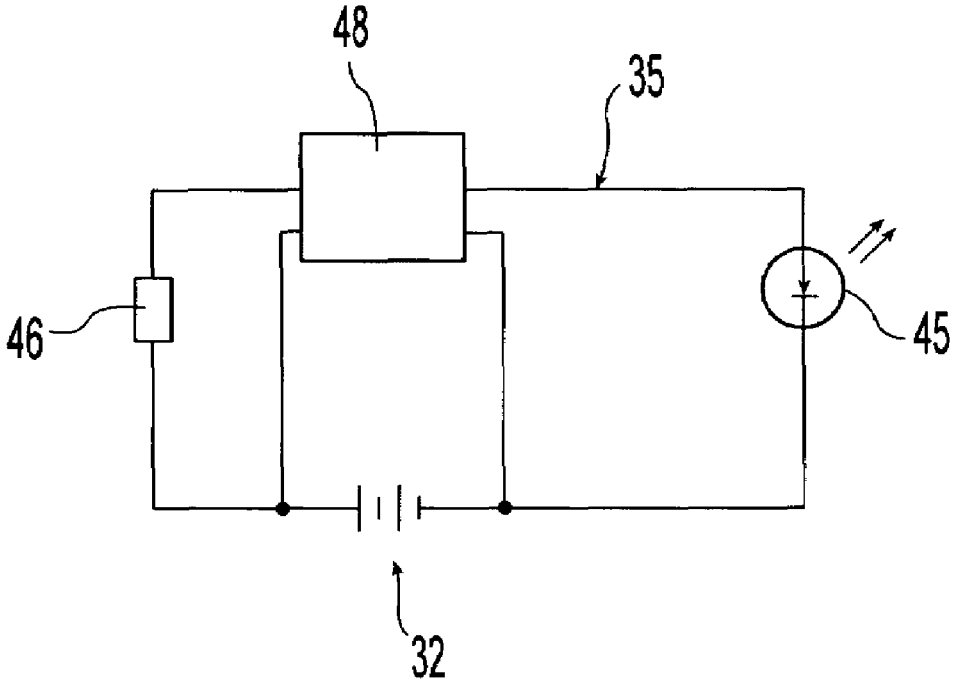
FIG. 4 is a schematic representation of an alternative circuit for selectively activating a light source disposed on a glove.

FIG. 4 provides a schematic diagram of a modified embodiment of the invention. In this embodiment, the light source is a light emitting diode ("LED") 45 which is operably coupled with electrical power source 32 by electrical circuit 35. The embodiment of FIG. 4 also includes a flexure responsive circuit element 46. While the flexure responsive circuit element 46 in FIG. 4 could be a mechanically operable electrical switch similar to switch 36 in FIGS. 1-3, it may also take alternative forms.

The embodiment of FIG. 4 also includes a control circuit 48 which may take the form of a printed circuit board. Control circuit 48 is operably coupled with electrical circuit 35 and flexure responsive circuit element 46 whereby control circuit 48 selectively energizes and de-energizes light source 45 in response to operating characteristics of the flexure responsive circuit element 46. For example, circuit element 46 may be a "strain gauge" or similar device wherein circuit element 46 experiences a change in resistance in response to a change in its shape due to the flexure of the item of apparel 22 on which element 46 is mounted. The resistance of circuit element 46 would then be sensed by control circuit 48 which would then selectively energize or de-energize LED 45 in response to this sensed resistance of the flexure responsive circuit element 46. Alternative flexure responsive circuit elements that may also be employed include an electronic transducer for measuring flexion disclosed by Cimmino in U.S. Pat. No. 6,725,729 B1 which is hereby expressly incorporated herein by reference.

The various forms of flexure responsive circuit element 46 all experience a change in operating characteristics when subjected to a change in shape. In other words, circuit element 46 can be mounted on patch 38 or other suitable location on glove 22 such that when glove 22 is in a grasping configuration 22*a*, circuit element 46 will have one shape with a corresponding set of operating characteristics and when glove 22 is in an outstretched configuration 22*b*, circuit element 46 will have a different shape and a different set of operating characteristics. Control circuit 48 will sense the changeable operating characteristic and energize and de-energize LED 45 in response to the sensed, changeable operating characteristic of circuit element 46.

It is only necessary for one of the operating characteristics of circuit element 46 to vary, provided that such characteristic can be sensed by control circuit 48. For example, switch 36 conducts electrical current across the switch when closed and prevents the flow of electrical current when it is open while a strain gauge and other similar device experiences a change in its electrical resistance when subjected to a change in strain caused by a change of shape.

The use of a control circuit 48 in combination with a flexure responsive circuit element 46 rather than the use of only an electrical switch 36 provides a greater range of options in the operation of the light source. For example, control circuit 48 can be configured to energize LED 45 in multiple different modes of operation such as (a) an energized mode wherein the light source is continuously energized; (b) a de-energized mode wherein the light source is continuously de-energized; and (c) a flashing mode wherein the light source is repeatedly energized and de-energized.

The mode of operation is determined by the selective and repeated repositioning apparel item 22 between the first and second configurations 22*a* and 22*b*. It would be possible simply to toggle through the different modes of operation with each change in configuration 22*a*, 22*b*, however, with three modes of operation, this would not provide a consistent mode of operation for either of the apparel configurations 22*a*, 22*b*. Another possible method would be to return to a de-energized mode when the apparel items 22 is in configuration 22*a* with the energized mode being the result of a single repositioning of apparel item 22 from configuration 22*a* to configuration 22*b* and the flashing mode of operation resulting from two quick repositionings from configuration 22*a* to configuration 22*b*, e.g., within 2 seconds. Various other methods of controlling the actuation of the different modes of operation could also be employed with the present invention.

It is further noted that while the illustrated item of apparel 22 is a single glove, other forms of apparel may be employed with the present invention. For example, battery 32 could be mounted on a wrist band with flexure responsive circuit element 46 and control circuit 48 being mounted on one finger band and LED 45 being mounted on a separate finger band with wiring forming electrical circuit 35 extending between the various bands.

Figure 5:
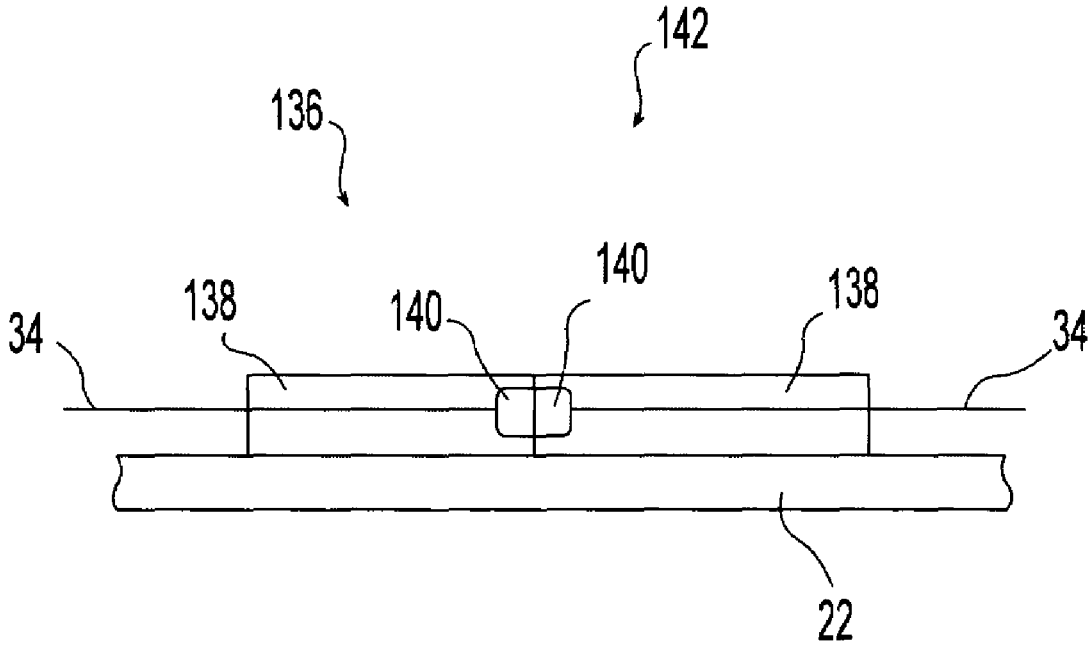
FIG. 5 is a schematic cross sectional view of an alternative flexure responsive circuit element.
Figure 6:
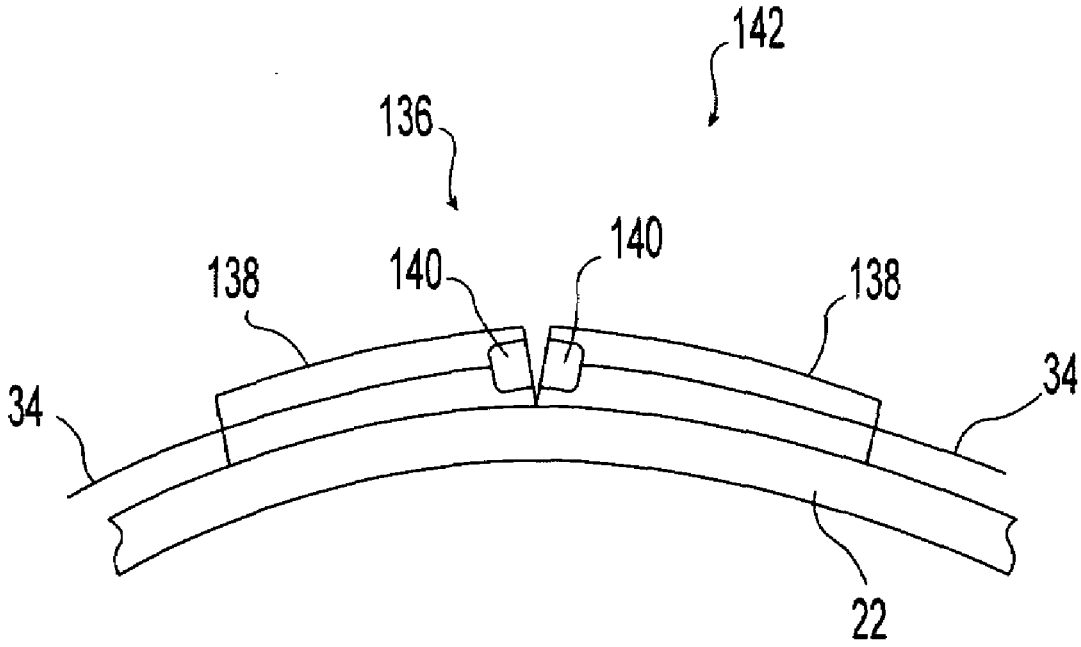
FIG. 6 is another schematic cross sectional view of the flexure responsive circuit element of FIG. 5.

FIGS. 5 and 6 illustrate an alternative flexure responsive circuit element 136 that may also be used with the present invention. Circuit element 136 is a mechanically operated electrical switch and could be substituted for the electrical switch 36 in apparatus 20 illustrated in FIGS. 1-3 and which would allow a user to operate apparatus 20 as described above with reference to FIGS. 1-3.

As seen in FIGS. 5 and 6, circuit element 136 has a flexible mounting patch 138 that is mounted on apparel layer 22 to form layered structure 142. Mounting patch 138 is positioned at the same location as patch 38 on the index finger portion of apparel 22. As seen in FIGS. 5 and 6, mounting patch 138 is slit at its midpoint. Rather than mounting contacts and wiring on the top of patch 138, electrical contacts 140 and wiring 34 are embedded within mounting patch 138.

When circuit element 136 is positioned as shown in FIG. 5, the two halves of patch 138 are in registration and contacts 140 are in conductive engagement and provide a conductive path across element 136 and thereby energizing light 44. The shape of element 136 depicted in FIG. 5 corresponds to an outstretched configuration 22*b* of apparel 22. Layered structure 142 is flexed as apparel 22 is moved from an outstretched configuration 22*b* to a grasping configuration 22*a*. Flexure responsive circuit element 136 experiences a change in curvature and strain as apparel 22 is moved between configurations 22*a* and 22*b* and the shape of circuit element 136 shown in FIG. 6 corresponds to a grasping configuration 22*a* of apparel 22. When layered structure 142 is flexed as apparel 22 is placed in the grasping configuration 22*a*, circuit element 136 is bent as shown in FIG. 6 thereby separating contacts 140, opening the conductive path of circuit 35 and de-energizing light 44.

While this invention has been described as having an exemplary design, the present invention may be further modified within the spirit and scope of this disclosure. This application is therefore intended to cover any variations, uses, or adaptations of the invention using its general principles.

What is claimed is:

1. An apparatus controllable by a hand of a user, said apparatus comprising:

at least one article of apparel mountable on the hand of the user, said apparel being repositionable between a first configuration and a second configuration as the user's hand is repositioned between a first shape and a second shape;

an electrical power source;

a light source disposed on said apparel, said light source emitting light when energized by said electrical power source;

an electrical circuit disposed on said apparel and operably coupled with said electrical power source and said light source; and a flexure responsive circuit element disposed on said apparel wherein said circuit element and said apparel define a layered structure, said circuit element operably coupled with said electrical circuit, movement of said apparel between said first and second configurations flexing said layered structure wherein said flexure responsive circuit element flexes between a first shape when said apparel is in said first configuration and a second shape when said apparel is in said second configuration, movement of said circuit element between said first and second shapes subjecting said circuit element to a change in curvature and strain, said circuit element having a first set of operating characteristics within said electrical circuit when positioned in said first shape and a different second set of operating characteristics within said electrical circuit when said circuit element is positioned in said second shape, the energizing and de-energizing of said light source being responsive to said operating characteristics of said circuit element.

2. The apparatus of claim 1 wherein said electrical power source comprises a battery disposed on said apparel.

3. The apparatus of claim 1 wherein said light source comprises a light emitting diode.

4. The apparatus of claim 1 wherein said at least one article of apparel consists of a single article of apparel adapted to envelope at least a portion of at least one finger on the user's hand and at least a portion of the metacarpal area, of the user's hand.

5. The apparatus of claim 4 wherein said flexure responsive circuit element is entirely positioned on said apparel at a location where said apparel is adapted to envelope a portion of a single finger of the user.

6. The apparatus of claim 1 wherein said flexure responsive circuit element comprises a mechanically operated electrical switch, said switch being closed when in said first shape and said switch being open when in said second shape.

7. The apparatus of claim 6 wherein said switch includes first and second contacts wherein said first and second contacts are in conductive engagement when said switch is in said first shape, and wherein positioning said switch in said second shape bends said switch and thereby separates said first and second contacts.

8. The apparatus of claim 1 wherein said flexure responsive circuit element defines a first electrical resistance in said first shape and a second electrical resistance in said second shape.

9. The apparatus of claim 8 further comprising a control circuit operably coupled with said circuit element, said control circuit selectively energizing and de-energizing said light source in response to a sensed resistance of said circuit element.

10. An apparatus controllable by a hand of a user, said apparatus comprising:

at least one article of apparel mountable on the hand of the user, said apparel being repositionable between a first configuration and a second configuration as the user's hand is repositioned between a first shape and a second shape;

an electrical power source;

a light source disposed on said apparel, said light source emitting light when energized by said electrical power source;

an electrical circuit disposed on said apparel and operably coupled with said electrical power source and said light source, said light source being selectively energized by said electrical power source through said electrical circuit;

a control circuit disposed on said apparel and operably coupled with said electrical circuit; and a flexure responsive circuit element disposed on said apparel and operably coupled with said control circuit, said flexure responsive circuit element operably flexing between a first shape when said apparel is in said first configuration and a second shape when said apparel is in said second configuration, said circuit element having a first set of operating characteristics within said electrical circuit when positioned in said first shape and a different, second set of operating characteristics within said electrical circuit when said circuit element is positioned in said second shape, said control circuit energizing and de-energizing said light source in response to said operating characteristics of said circuit element.

11. The apparatus of claim 10 wherein said electrical power source comprises a battery disposed on said apparel.

12. The apparatus of claim 10 wherein said light source comprises a light emitting diode.

13. The apparatus of claim 10 wherein said at least one article of apparel consists of a single article of apparel adapted to envelope at least a portion of at least one finger on the user's hand and at least a portion of the metacarpal area of the user's hand and said flexure responsive circuit element is entirely positioned on said apparel at a location where said apparel is adapted to envelope a portion of a single finger of the user.

14. The apparatus of claim 10 wherein said circuit element defines a first electrical resistance in said first shape and a second electrical resistance in said second shape.

15. The apparatus of claim 10 wherein said control circuit is configured to define at least three modes of operation of said light source, said modes of operation including:

(a) an energized mode wherein said light source is continuously energized;

(b) a de-energized mode wherein said light source is continuously de-energized; and (c) a flashing mode wherein said light source is repeatedly energized and de-energized;

said mode of operation being determined by selectively flexing said flexure responsive circuit element between said first and second shapes of said circuit element.

16. A method of operating a light source, said method comprising:

providing at least one article of apparel, the apparel being wearable by a user proximate a hand of the user, the apparel being repositionable between a first configuration and a second configuration as the user's hand is repositioned between a first shape and a second shape;

mounting the light source on the apparel;

mounting a flexure responsive circuit element on the apparel wherein the flexure responsive circuit element operably flexes between a first shape when the apparel is in the first configuration and a second shape when the apparel is in the second configuration, the circuit element having a first set of operating characteristics when positioned in the first shape and a different second set of operating characteristics when the circuit element is positioned in the second shape; and selectively energizing and de-energizing the light source in response to the operating characteristics of the circuit element.

17. The method of claim 16 wherein the light source is operable in at least three different modes, the modes of operation including:

(a) an energized mode wherein the light source is continuously energized;

(b) a de-energized mode wherein the light source is continuously de-energized; and (c) a flashing mode wherein the light source is repeatedly energized and de-energized;

the mode of operation being determined in response to the selective and repeated repositioning of the apparel between the first and second configurations.

18. The method of claim 16 wherein the at least one article of apparel consists of a single article of apparel enveloping at least a portion of at least one finger on the user's hand and at least a portion of the metacarpal area of the user's hand and the flexure responsive circuit element is entirely positioned on the apparel at a location where the apparel envelopes a single finger of the user's hand.

19. The method of claim 16 further comprising:

mounting a battery to the apparel and operably coupling the battery with the light source wherein the light source is selectively energized by the battery.

20. The method of claim 19 further comprising:

mounting an electrical circuit on the apparel and operably coupling the light source, the flexure responsive circuit element, and the battery with the electrical circuit.

21. The method of claim 20 wherein the flexure responsive circuit element is a mechanically operated electrical switch, the switch being closed when in the first shape and the switch being open when in the second shape.

22. The method of claim 20 wherein the flexure responsive circuit element defines a first electrical resistance in the first shape and a second electrical resistance in the second shape; and wherein the method further comprises:

mounting a control circuit on the apparel and operably coupling the control circuit with the electrical circuit and the flexure responsive circuit element wherein the control circuit selectively energizes and de-energizes the light source in response to a sensed resistance of the circuit element.

23. The method of claim 22 wherein the control circuit energizes and de-energizes the light source in at least three different modes of operation, the modes of operation including:

(a) an energized mode wherein the light source is continuously energized;

(b) a de-energized mode wherein the light source is continuously de-energized; and (c) a flashing mode wherein the light source is repeatedly energized and de-energized; and, wherein the method further includes:

selecting the mode of operation by selectively repositioning the apparel between the first and second configurations.

24. An apparatus controllable by a hand of a user, said apparatus comprising:

at least one article of apparel mountable on the hand of the user, said apparel being repositionable between a first configuration and a second configuration as the user's hand is repositioned between a first shape and a second shape;

an electrical power source;

a light source operably coupled to said electrical power source, said light source emitting light when energized by said electrical power source; and, flexure responsive circuit means disposed on said apparel and operably coupled to said electrical power source and said light source for controlling the energizing and de-energizing of said light source in response to flexing of said flexure responsive circuit, said flexing of said flexure responsive circuit resulting from said apparel being repositioned between said first and second configurations.

* * * * *